US007634206B2

(12) United States Patent
Hagiwara et al.

(10) Patent No.: US 7,634,206 B2
(45) Date of Patent: Dec. 15, 2009

(54) CHARGING DEVICE, IMAGE FORMING APPARATUS USING THE SAME AND CHARGING CONTROLLING METHOD

(75) Inventors: Takuro Hagiwara, Kanagawa (JP); Akihiro Ida, Kanagawa (JP); Yoshihisa Kitano, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 503 days.

(21) Appl. No.: 11/657,568

(22) Filed: Jan. 25, 2007

(65) Prior Publication Data

US 2007/0297819 A1 Dec. 27, 2007

(30) Foreign Application Priority Data

Jun. 23, 2006 (JP) ..... 2006-173893

(51) Int. Cl.
*G03G 15/00* (2006.01)

(52) U.S. Cl. ..... 399/44; 399/50

(58) Field of Classification Search ..... 399/38, 399/44, 50, 75, 88, 89, 115
See application file for complete search history.

(56) References Cited

U.S. PATENT DOCUMENTS 5,276,483 A * 1/1994 Hasegawa et al. ..... 399/44
5,646,717 A * 7/1997 Hiroshima et al. ..... 399/154
5,805,954 A * 9/1998 Takahashi ..... 399/44
7,139,501 B2 * 11/2006 Takami et al. ..... 399/89

FOREIGN PATENT DOCUMENTS

JP A-07-239603 9/1995
JP A-2004-333789 11/2004

* cited by examiner

*Primary Examiner*—Hoan H Tran
(74) *Attorney, Agent, or Firm*—Morgan, Lewis & Bockius LLP

(57) ABSTRACT

A charging device includes a charging member disposed so as to rotate in contact with a surface of an image carrier to charge the image carrier surface, a bias voltage applying unit that applies a bias voltage to the charging member, the bias voltage having an AC voltage superimposed on a DC voltage, a DC current detector that detects a DC current flowing between the image carrier and the charging member, a filter that extracts only a specific component from the DC current detected by the DC current detector, and a controller that controls at least one of an AC voltage and an AC current to be applied to the charging member in accordance with an amount of variation of the specific component extracted from the DC current by the filter.

12 Claims, 11 Drawing Sheets

CHARGING DEVICE, IMAGE FORMING APPARATUS USING THE SAME AND CHARGING CONTROLLING METHOD

CROSS-REFERENCE TO RELATED APPLICATIONS

This application is based on and claims priority under 35 USC 119 from Japanese Patent Application No. 2006-173893 filed Jun. 23, 2006.

BACKGROUND

1. Technical Field

The present invention relates to a charging device for use in an image forming apparatus such as an electrophotographic printer or copying machine or a facsimile, an image forming apparatus using the charging device and a charging controlling method.

2. Related Art

Heretofore, as a charging device used in an image forming apparatus such as an electrophotographic printer or copying machine or a facsimile, there has been used a contact type charging device wherein a charging roller is disposed in contact with the surface of a photoreceptor drum and an AC voltage or an AC voltage with a DC voltage superimposed thereon is applied to the charging roller to charge the drum surface uniformly to a predetermined potential.

As such a contact type charging device, there is known a charging device wherein, in order to suppress both the occurrence of unevenness in charging, i.e., non-uniform charging of the surface of a photoreceptor drum, and the creation of discharge products such as ozone and nitrogen oxides, a DC current flowing between the photoreceptor drum and a charging roller is detected and an AC voltage or current to be applied to the charging roller is controlled in accordance with the amount of variation of the detected DC current.

However, the current value of DC component in a bias voltage is used as information on variations in charging of the photoreceptor drum and the voltage of AC component is adjusted on the basis of the current value of DC component in the bias voltage, further, the bias control value applied during image formation to the contact charging member is determined by a value obtained by multiplying an alternating electric field value at a deviated point of an alternating electric field value−DC value from linearity by a predetermined ratio when the alternating electric field is gradually increased or decreased for a predetermined timing in a condition of not forming an image.

However, the current value of DC component flowing in the charging unit which is in contact with the image carrier is not only very small but also, according to measurement results obtained by the present inventors, as shown in FIG. 12, it is at the same level as the entire noise and there is no change in variation width (about 0.75 μA) of the current value of the DC component before and after saturation of the surface potential of the photoreceptor drum to a predetermined potential with a gradual increase of the AC voltage applied to the charging member.

Thus, according to the techniques, even if an attempt is made to control the AC voltage (alternating electric field) applied to the charging member on the basis of the current value of DC component in the bias voltage or the value detected by the DC current detecting unit, the current value of DC component in the bias voltage cannot be detected with a high accuracy, with the result that the charging potential of the image carrier such as a photoreceptor drum cannot be controlled with a high accuracy.

SUMMARY

According to an aspect of the invention, there is provided a charging device including: a charging member disposed so as to rotate in contact with a surface of an image carrier to charge the image carrier surface; a bias voltage applying unit that applies a bias voltage to the charging member, the bias voltage having an AC voltage superimposed on a DC voltage; a DC current detector that detects a DC current flowing between the image carrier and the charging member; a filter that extracts only a specific component from the DC current detected by the DC current detector; and a controller that controls at least one of an AC voltage and an AC current to be applied to the charging member in accordance with an amount of variation of the specific component extracted from the DC current by the filter.

BRIEF DESCRIPTION OF THE DRAWINGS

Exemplary embodiments of the present invention will be described in detail based on the following figures, wherein.

DETAILED DESCRIPTION

Figure 1:
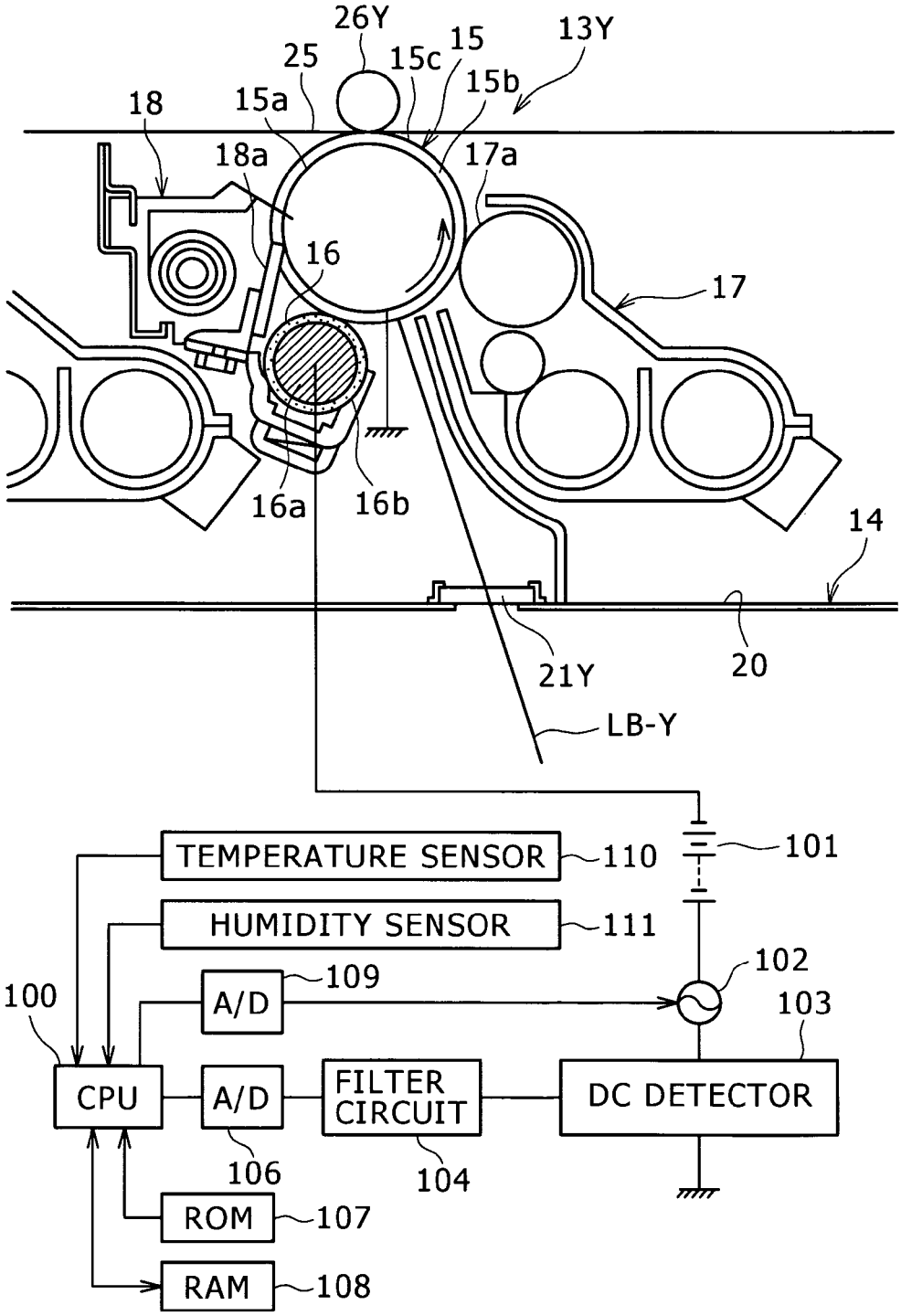
FIG. 1 is a construction diagram showing a principal portion of a color multifunctional machine using a charging device according to a first exemplary embodiment of the present invention.

Exemplary embodiments of the invention will be described referring to the drawings.

First Exemplary Embodiment

Figure 2:
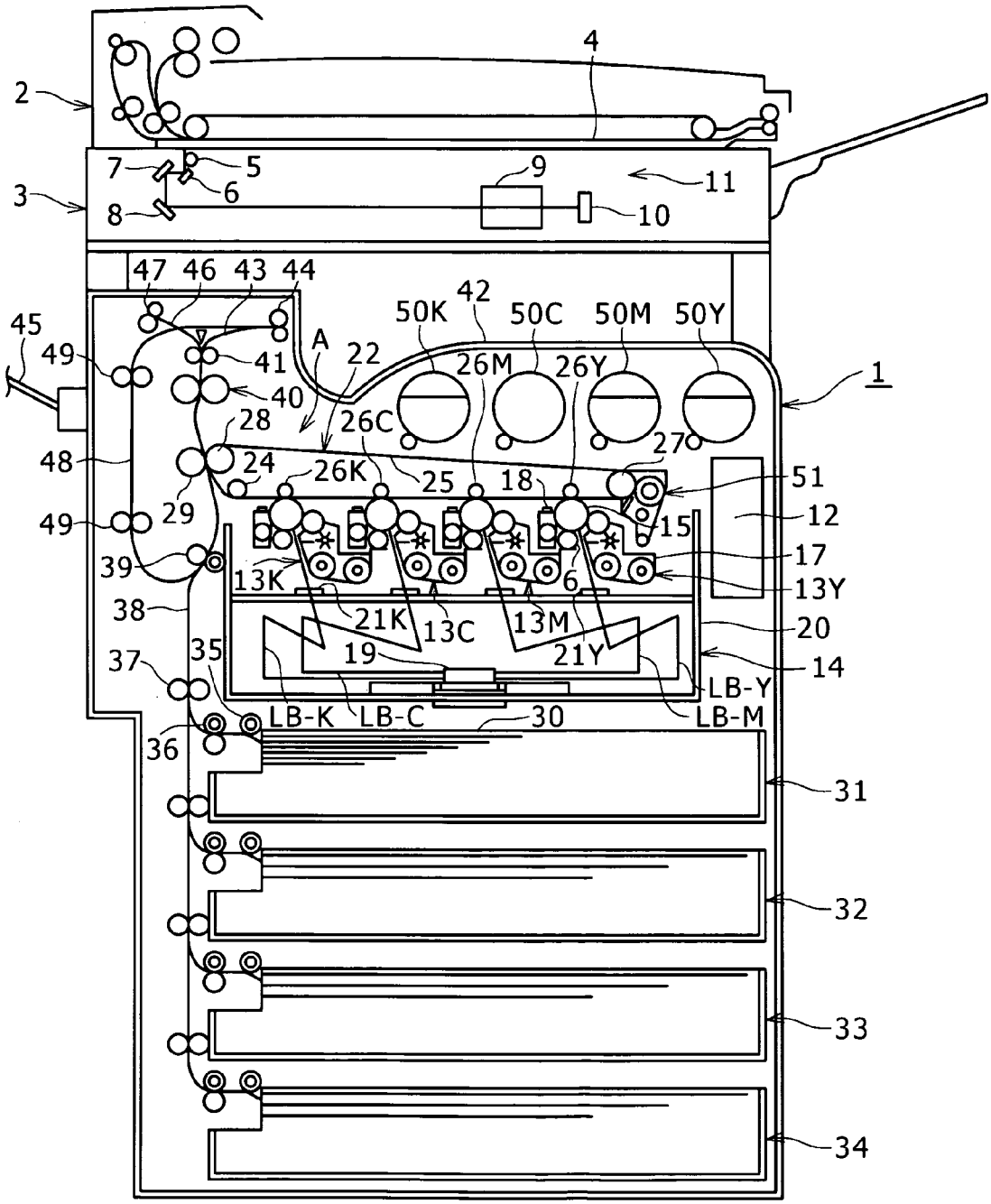
FIG. 2 is an entire construction diagram showing the color multifunctional machine using the charging device of the first exemplary embodiment.

FIG. 2 is a construction diagram showing a color multifunctional machine as an image forming apparatus using a charging device according to a first exemplary embodiment of the present invention. This color multifunctional machine also possesses the function as a copying machine, a printer or a facsimile.

As shown in FIG. 2, this color multifunctional machine, indicated at 1, is provided with a scanner 3 as an image reader and is connected to a personal computer (not shown) through a network (not shown).

The color multifunctional machine copies an image of a document read by the scanner, makes printing on the basis of image data fed from the personal computer, and functions as a facsimile which transmits and receives image data through a telephone line.

In FIG. 2, the numeral 1 denotes a body of the color multifunctional machine, and above the color multifunctional machine body 1 are disposed an automatic document feeder (ADF) 2 for automatically feeding documents (not shown) separately one by one and a scanner 3 for reading images from the documents being conveyed by the automatic document feeder 2. In the scanner 3, a document placed on a platen glass 4 is illuminated by a light source 5 and a reflected light image reflected from the document is passed through a reducing optical system 11 made up of a full-rate mirror 6, half-rate mirrors 7, 8 and a focusing lens 9, then is scanned and exposed onto an image reader 10, which in turn reads a reflected colorant light image from the document at a predetermined dot density (e.g., 16 dots/mm).

The reflected light image of the document read by the scanner 3 is fed as three-color reflectance data of, say, red (R), green (G) and blue (B) (each 8 bits) to an image processor 12 (IPS). In the image processor 12, a predetermined image processing as will be described later, including as necessary shading correction, correction of positional deviation, lightness/color space conversion, gamma correction, frame erasing, and color/mobile editing, is performed for the image data of the document. The image processor 12 performs the predetermined image processing also from image data fed from a personal computer (not shown) or the like.

The image data thus subjected to the predetermined image processing in the image processor 12 is converted to a four-color gradation data (image data) of yellow (Y), magenta (M), cyan (C), and black (K) (each 8 bits) also by the image processor 12, then is fed to an ROS (Raser Output Scanner) 14. In the ROS 14 as an image write unit, image exposure is performed using a laser beam LB in accordance with gradation data of predetermined colors. It goes without saying that there may be formed not only a color image but also only a black-and-white image.

As shown in FIG. 2, an image forming unit A is disposed in the interior of the color multifunctional machine 1 and four image forming units 13Y, 13M, 13C and 13K of yellow (Y), magenta (M), cyan (C) and black (K) are arranged in parallel spacedly a predetermined distance in the horizontal direction.

The four image forming units 13Y, 13M, 13C and 13K are all of the same construction and are each roughly made up of a photoreceptor drum 15 as an image carrier which is rotated at a predetermined speed, a charging roller 16 as a contact type charger adapted to charge the surface of the photoreceptor drum 15 uniformly, the ROS 14 as an image write unit adapted to expose an image corresponding to a predetermined color onto the surface of the photoreceptor drum 15 to form an electrostatic latent image, a developing device 17 as a developing unit which develops the electrostatic latent image formed on the photoreceptor drum 15 with use of a toner of the predetermined color, and a cleaning device 18 for cleaning the surface of the photoreceptor drum 15. The photoreceptor drum 15 and the image forming members arranged around the photoreceptor drum are unitized integrally and the image forming units 13Y, 13M, 13C and 13K can be replaced each independently from the color multifunctional machine body 1.

As shown in FIG. 2, the ROS 14 is constructed in common to the four image forming units 13Y, 13M, 13C, and 13K. It is constructed in such a manner that four semiconductor lasers (not shown) are modulated in accordance with image data of the four colors respectively and laser beams LB-Y, LB-M, LB-C, and LB-K are outputted in accordance with the image data. The ROS 14 may be constructed for each of the plural image forming units. The laser beams LB-Y, LB-M, LB-C, and LB-K emitted from the semiconductor lasers are radiated to a polygon mirror 19 via an f-θ lens (not shown) and are deflection-scanned by the polygon mirror 19, then are scanned and exposed obliquely from below to exposure points on the photoreceptor drums 15 via a focusing lens and plural mirrors (neither shown).

As shown in FIG. 2, the ROS 14 is for scanning and exposure of images from below onto the photoreceptor drums 15 and is therefore likely to be stained with toner or the like dropping from the developing devices 17 in the four image forming units 13Y, 13M, 13C, and 13K positioned above. To avoid such an inconvenience, the ROS 14 is closed throughout its periphery by a frame 20 of a rectangular parallelepiped and transparent glass windows 21Y, 21M, 21C, and 21K as shield members are formed in upper positions of the frame 20 in order to permit exposure of the four laser beams LB-Y, LB-M, LB-C, and LB-K onto the photoreceptor drums 15 of the image forming units 13Y, 13M, 13C, and 13K, respectively.

Color image data is outputted successively from the image processor 12 to the ROS 14 which is provided in common to the image forming units 13Y, 13M, 13C, and 13K of the four colors of yellow (Y), magenta (M), cyan (C), and black (K) and laser beams LB-Y, LB-M, LB-C, and LB-K emitted from the ROS 14 in accordance with the image data are scanned and exposed onto the surfaces of the corresponding photoreceptor drums 15 to form electrostatic latent images. The electrostatic latent images thus formed on the photoreceptor drums 15 are developed as toner images of yellow (Y), magenta (M), cyan (C), and black (K) by developing devices 17Y, 17M, 17C, and 17K, respectively.

The toner images of yellow (Y), magenta (M), cyan (C), and black (K) formed successively only the photoreceptor drum 15 of the image forming units 13Y, 13M, 13C, and 13K are transferred in a multiple fashion by four first transfer rollers 26Y, 26M, 26C, and 26K onto an intermediate transfer belt 25 of a transfer unit 22 which is disposed above the image forming units 13Y, 13M, 13C, and 13K. The first transfer rollers 26Y, 26M, 26C, and 26K are disposed on the back side of the intermediate transfer belt 25 at positions corresponding to the photoreceptor drums 15 of the image forming units 13Y, 13M, 13C, and 13K. A volume resistance value of the first transfer rollers 26Y, 26M, 26C, and 26K in this exemplary embodiment has been adjusted to $10^5$ to $10^8$ Ωc. A transfer bias power supply (not shown) is connected to the first transfer rollers 26Y, 26M, 26C, and 26K, whereby a transfer bias reverse in polarity (positive polarity in this exemplary embodiment) to a predetermined toner polarity is applied at a predetermined timing to each of the first transfer rollers.

As shown in FIG. 2, the intermediate transfer belt 25 is stretched between and entrained with a predetermined tension onto a drive roller 27 and a tension roller 24 and is driven circulatively in the direction of arrow at a predetermined speed by the drive roller 27 which is rotated with a dedicated drive motor (not shown) superior in point of constant speed. The intermediate transfer belt 25 is formed, for example, using a belt material (rubber or resin) which does not cause charging-up.

The toner images of yellow (Y), magenta (M), cyan (C), and black (K) thus transferred in a multiple fashion onto the intermediate transfer belt 25 are transferred secondarily onto paper 30 as a sheet by a second transfer roller 29 which is in pressure contact with a backup roller 28, as shown in FIG. 2. The paper 30 with the four-color toner images thus transferred thereon is conveyed to a fixing device 40 positioned above. The second transfer roller 29 is in pressure contact with a side face of the backup roller 28 and transfers the four-color toner images secondarily onto the paper 30 being conveyed from below to above.

The paper 30 of a predetermined size from any of paper feed trays 31, 32, 33, and 34 which are disposed in plural stages in the lower portion of the color multifunctional machine body 1 is fed separately one by one by a feed roller 35 and a retard roller 36 via a paper conveyance path 38 provided with conveyance rollers 37. The paper thus fed from any of the paper feed trays 31, 32, 33, and 34 is once stopped by a registration roller 39 and then, in synchronism with the images on the intermediate transfer belt 25, is again fed to a second transfer position on the belt 25.

Subsequently, as shown in FIG. 2, the paper 30 with the four-color toner images thus transferred thereon is subjected to a fixing process with heat and pressure in a fixing device 40 and is then discharged, with its image-forming surface down, onto a face-down tray 42 as a first discharge tray by conveyance rollers 41 and discharge rollers 44 disposed in an outlet of a first paper conveyance path 43 via the same path, the first paper conveyance path 43 being a path for discharging the paper onto the face-down tray 42.

In the case where the paper 30 with images thus formed thereon is to be discharged with its image-forming surface up, as shown in FIG. 2, the paper 30 is discharged, with its image-forming surface up, onto a face-up tray 45 as a second discharge tray disposed sideways (on the left side face in the figure) of the machine body 1 by discharge rollers 47 disposed in an outlet of a second paper conveyance path 46 via the same path, the second paper conveyance path 46 being a path for discharging the paper onto the face-up tray 45.

To take double-sided copies of full color for example in the color multifunctional machine, as shown in FIG. 2, the conveyance direction of the paper 30 with an image fixed to one side thereof is changed by a switching gate (not shown) without discharging it directly onto the face-down tray 42 through the discharge rollers 44 and the discharge rollers 44 are once stopped and then rotated in the reverse direction to convey the paper to a paper conveyance path 48 as a double-side copying path. Conveyance rollers 49 are disposed along the conveyance path 48, whereby the paper 30 is conveyed in an inverted state to the registration roller 39. Then, this time an image is transferred and fixed to the back side of the paper 30 and thereafter the paper is discharged to the face-down tray 42 or the face-up tray 45 via the first paper conveyance path 43 or the second paper conveyance path 46.

In FIG. 2, the numerals 50Y, 50M, 50C, and 50K denote toner cartridges for the supply of toners of predetermined colors to the developing devices 17 of yellow (Y), magenta (M), cyan (C), and black (K), and the numeral 51 denotes a cleaning device for cleaning the surface of the intermediate transfer belt 25.

Figure 3:
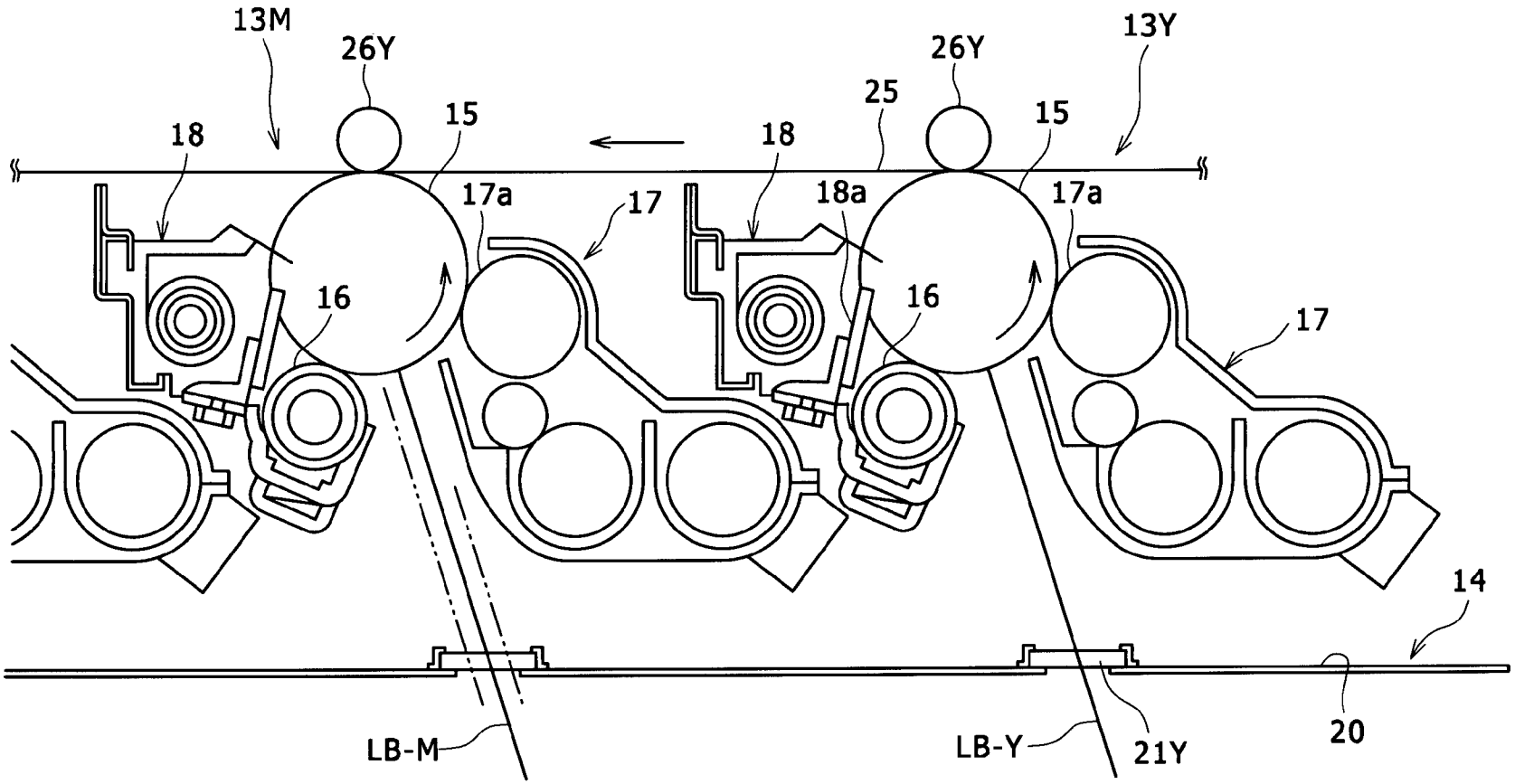
FIG. 3 is a construction diagram showing an image forming unit in the color multifunctional machine using the charging device of the first exemplary embodiment.

FIG. 3 shows the image forming units in the color multifunctional machine.

As shown in FIG. 3, the four image forming units 13Y, 13M, 13C, and 13K of yellow, magenta, cyan, and black, respectively, are of the same construction, in which toner images of yellow, magenta, cyan, and black are formed successively at a predetermined timing. As described earlier, the image forming units 13K, 13M, 13C, and 13K are provided with the photoreceptor drums 15, respectively. The surfaces of the photoreceptor drums 15 are electrically charged uniformly by the primary charging rollers 16. Thereafter, the surfaces of the photoreceptor drums 15 are scanned and exposed to image forming laser beams LB which are emitted in accordance with image data from the ROS 14, whereby electrostatic latent images corresponding to the colors are formed. The laser beams LB to be radiated for scan onto the photoreceptor drums 15 are set so as to be radiated obliquely from below at positions somewhat closer to the right side with respect to the positions just under the drums 15. The electrostatic latent images formed on the photoreceptor drums 15 are developed into visible toner images using toners of yellow, magenta, cyan, and black, by means of developing rollers 17*a* of the developing devices 17 in the image forming units 13Y, 13M, 13C, and 13K. These visible toner images are transferred successively in a multiple fashion onto the intermediate transfer belt 25 by electric charging of the first transfer rollers 26. The developing devices 17 in the image forming units 13Y, 13M, 13C, and 13K may be of the type using a developer of a two-component system formed of toner and carrier or of the type using a developer of a one-component system of toner alone.

After completion of the toner image transfer process, residual toners on the surfaces of the photoreceptor drums 15 are removed by cleaning blades 18*a* of the cleaning devices 18, now ready for the next image forming process. In each of the cleaning devices 18, for convenience' sake, the tips of the cleaning blade 18*a* and sealing member are shown in an inserted state into the associated photoreceptor drum 15, but this intends to show a free condition before the tips of the cleaning blade 18*a* and sealing member come into abutment against the surface of the drum 15.

The charging device of this exemplary embodiment includes a charging member disposed so as to rotate in contact with a surface of an image carrier to charge the image carrier surface, a bias voltage applying unit that applies a bias voltage to the charging member, the bias voltage including an AC voltage superimposed on a DC voltage, a controller that controls at least one of an AC voltage and an AC current to be applied to the charging member, a DC current detector that detects a DC current flowing between the image carrier and the charging member, and a filter that extracts only a specific component from the DC current detected by the DC current detector, the controller controlling at least one of an AC voltage and an AC current to be applied to the charging member in accordance with the amount of variation of the specific component in the DC current extracted by the filter.

That is, as shown in FIG. 1, the color multifunctional machine using the above charging device is provided with charging rollers 16 as charging members disposed so as to rotate in contact with the surfaces of the photoreceptor drums 15 to charge the drum surfaces. As shown in FIG. 1, the charging rollers 16 are each constructed such that the outer periphery of a core metal 16*a* such as a stainless steel core is coated with a conductive or semiconductive elastic layer 16*b*. Where required, a release layer may be formed as the outermost layer of each charging roller 16. The outside diameter of each charging roller 16 is set at, say, 12 mm, but it goes without saying that a value other than this set value will do as well.

As each of the photoreceptor drums 15, there may be used any of various photoreceptor drums and there is no special limitation. For example, there is used a drum fabricated by coating the surface of a metallic cylinder 15*a* such as an aluminum or stainless steel cylinder with a charge transport layer (CTL) 15*b* which also functions as a charge producing layer to a thickness of about 10 to 30 μm and then coating the surface of the charge transport layer 15*b* with an overcoat layer 15*c* as a synthetic resin layer of a high hardness to a thickness of about 2 to 5 μm. The metallic cylinder 15*a* of each photoreceptor drum 15 is connected to ground. As the photoreceptor drum 15 there may be used one not having the overcoat layer 15*c*.

As shown in FIG. 1, a bias voltage with an AC voltage superimposed on a DC voltage is applied to a DC power supply 101 and an AC power supply 102 both as bias applying units. As the AC voltage, VAC, to be applied to the core metal 16*a* of each charging roller 16 there is used, for example, one having a peak-to-peak voltage of about 1.5 to 3.0 kV and a frequency of about 1000 to 1500 Hz. As the DC voltage, VDC, to be applied to the core metal 16*a* of each charging roller 16 there is used, for example, one ranging from about −600V to about −800V.

Figure 12:
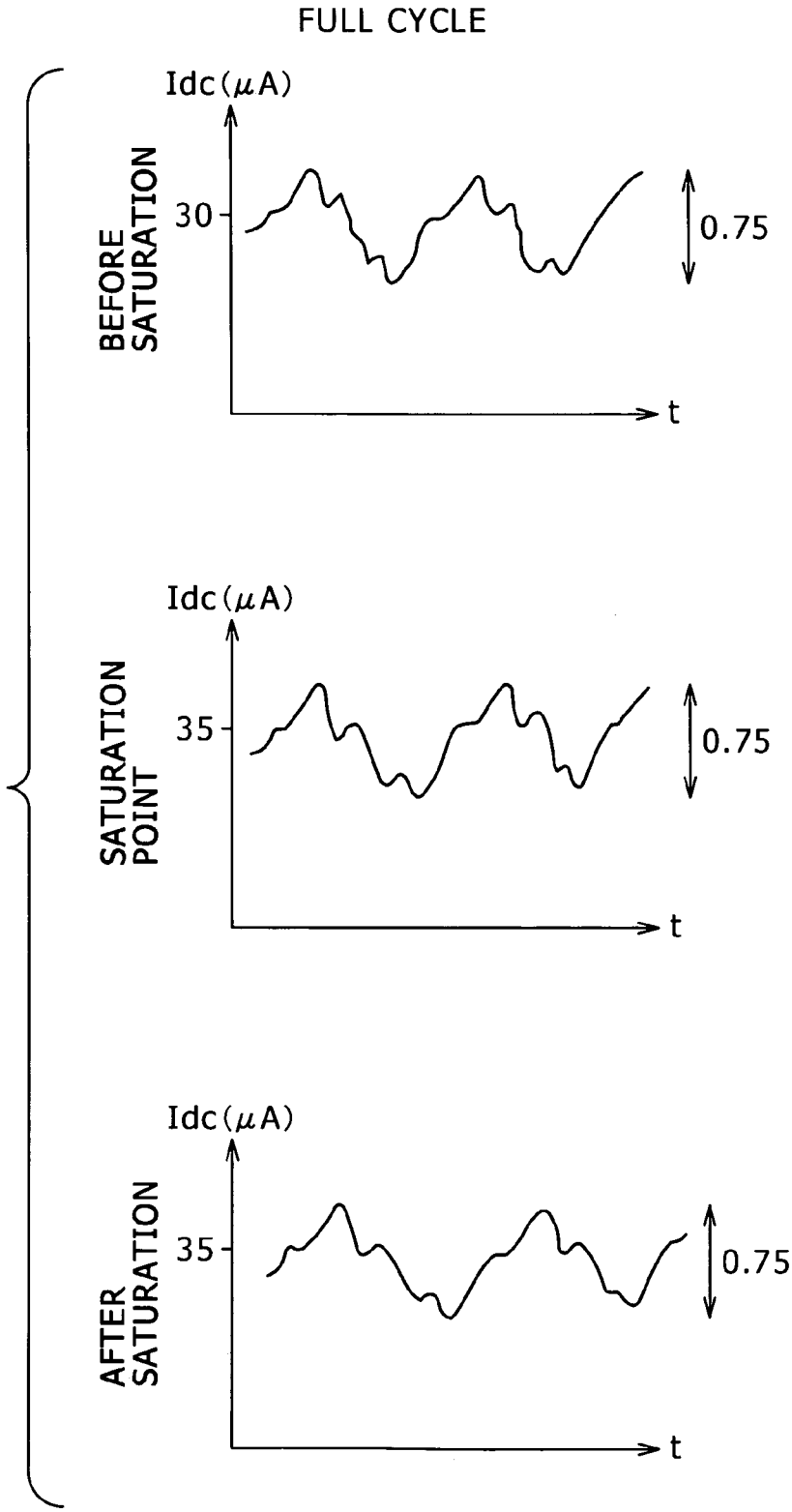
FIG. 12 RELATED ART
FIG. 12 is a group of graphs showing a DC current itself flowing in the charging roller in a charged condition of the surface of photoreceptor drum using a conventional charging device.

A DC current detecting circuit 103 as a DC current detector for detecting a DC current flowing between each charging roller 16 and the associated photoreceptor drum 15 is connected to the core metal 16*a* of the charging roller 16 in series with the DC power supply 101 and the AC power supply 102 and the core metal 16*a* is connected to ground via the DC current detecting circuit 103. A filter circuit 104 as a filter for extracting only a specific component from the DC current, Iac, detected by the DC current detecting circuit 103 is connected to the DC current detecting circuit 103. The specific component is, for example, a specific frequency component. The DC current Idc detected by the DC current detecting circuit 103, which flows through the core metal 16*a* of each charging roller 16, does not always present a constant value, but varies due to various factors, e.g., noise, and it, as it is, contains a component which varies irregularly with time, as shown in FIG. 12.

The filter circuit 104 is a circuit which extracts only a specific frequency component from the DC current Idc detected by the DC current detecting circuit 103. For example, it is constituted by a band pass filter as a combination of both a low pass filter which passes therethrough a component of 2 Hz or lower and a high pass filter which passes therethrough a component of 1.6 Hz or higher.

Figure 4:
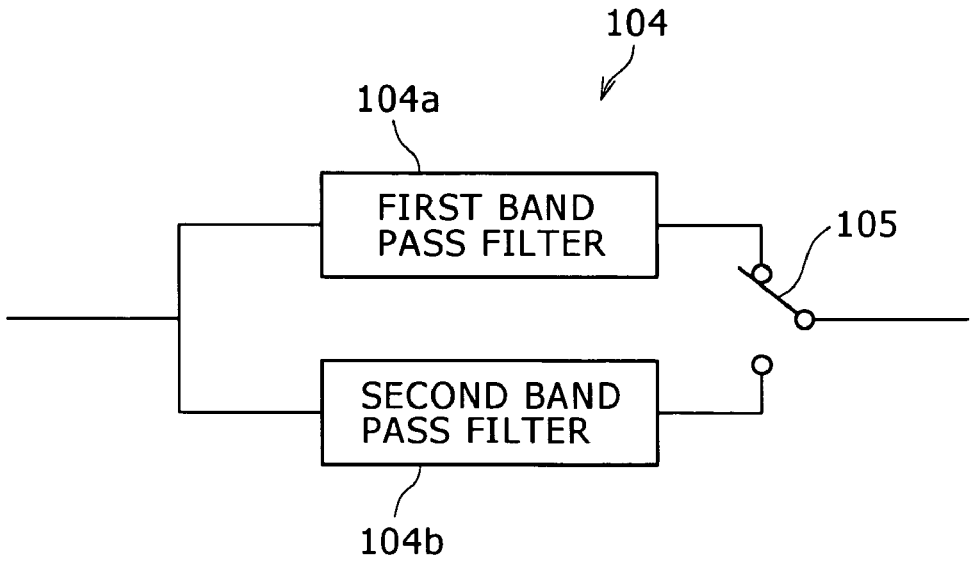
FIG. 4 is a block diagram showing a modification of a filter circuit used in the charging device of the first exemplary embodiment.

As the filter circuit 104 there may be used such a filter circuit as shown in FIG. 4 wherein there are provided a first band pass filter 104*a* as a combination of both a low pass filter which passes therethrough a component of 2 Hz or lower and a high pass filter which passes therethrough a component of 1.6 Hz or higher and a second band pass filter 104*b* as a combination of both a low pass filter which passes therethrough a component of 5 Hz or lower and a high pass filter which passes therethrough a component of 4.5 Hz or higher, the first and second band pass filters 104*a* and 104*b* being constructed so that they can be switch from one to the other by a change-over switch 105.

The filter circuit 104 is not limited to a combined band pass filter of both low and high pass filters, but may be constituted for example by only a low pass filter which passes only a component of 2 Hz or lower.

As shown in FIG. 1, the output of the filter circuit 104 is inputted to a CPU 100 as a controller via an A/D converter 106. The CPU 100 is constructed so as to control the whole of the color multifunctional machine on the basis of a program stored in a ROM 107 and with reference as necessary to a table or the like stored in a RAM 108 and control at least one of the AC voltage Vac and the AC current Iac to be applied to each charging roller 16. More specifically, the CPU 100 is constructed so as to control the output of the AC power supply 102 via the D/A converter 109 and control the AC current Iac out of the AC voltage Vac and the AC current Iac to be applied to the charging roller 16, but the CPU 100 may be constructed so as to control only the AC voltage Vac or control both Vac and Iac.

When the power supply of the color multifunctional machine is turned ON earliest in the morning, the CPU 100 executes a predetermined adjusting mode to control the AC current Iac to be applied to each charging roller 16. In the adjusting mode, the CPU 100 controls the output of the AC power supply 102 via the D/A converter 109 so that the AC current Iac to be applied to the charging roller 16 is changed predetermined value by predetermined value. At this time, the CPU 100 monitors a specific component of the DC current Idc flowing in the charging roller 16 via the filter circuit 104 and the A/D converter 106 and executes an adjusting operation for determining the AC current Iac to be applied to the charging roller 16.

Signals are inputted to the CPU 100 from a temperature sensor 110 which detects the internal temperature of the color multifunctional machine 1 and a humidity sensor 111 which detects the internal humidity of the color multifunctional machine.

In the color multifunctional machine using the charging device of this exemplary embodiment constructed as above, the DC current flowing in the contact type charging member can be detected highly accurately in the following manner and it is possible to control the charging potential of the image carrier with a high accuracy.

More particularly, in the color multifunctional machine according to this exemplary embodiment, the adjusting mode is executed for adjusting the AC current Iac to be applied to each charging roller 16 at a predetermined timing for example when power supply is turned ON in an earliest operation in the morning, or upon lapse of a predetermined time or longer in an unformed state of any image, or when image formation has been made by a predetermined number of sheets.

Figure 5:
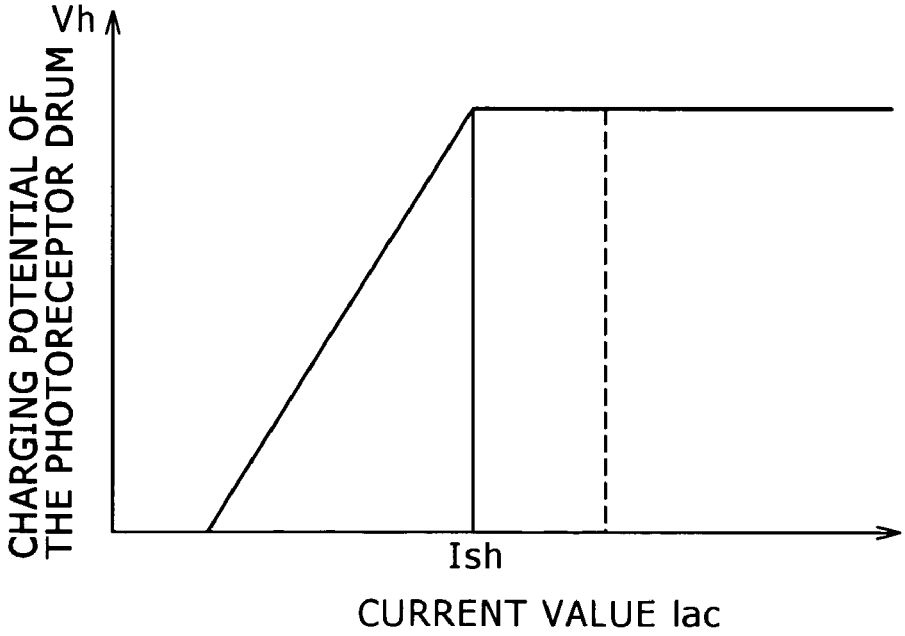
FIG. 5 is a graph showing a charging characteristic of a photoreceptor drum used in the charging device of the first exemplary embodiment.

In this adjusting mode, the CPU 100 makes reference to a table stored in the RAM 108, controls the AC power supply 102 via the D/A converter 109, causes the AC current Iac for each charging roller 16 to be changed stepwise for example like "80," "110," "115," "120," . . . "230," as shown in FIG. 5, and detects the DC current Idc in the charging roller 16 via the filter circuit 104 and the A/D converter 106. The aforesaid values "80," "110," "115," "120," . . . "230," represent the AC current Iac applied to each charging roller 16 in terms of digital values, not representing the very values of the AC current Iac.

Thus, as the AC current Iac applied to the charging roller 16 is increased gradually, the charging potential of the associated photoreceptor drum 15 also increases gradually as in FIG. 5, but it is known that, with a certain current value Ish of the AC current Iac as a boundary, the charging potential of the photoreceptor drum 15 becomes saturated to a certain value. The position at which the charging potential of the photoreceptor drum 15 becomes saturated is here designated a shoulder position.

Figure 6:
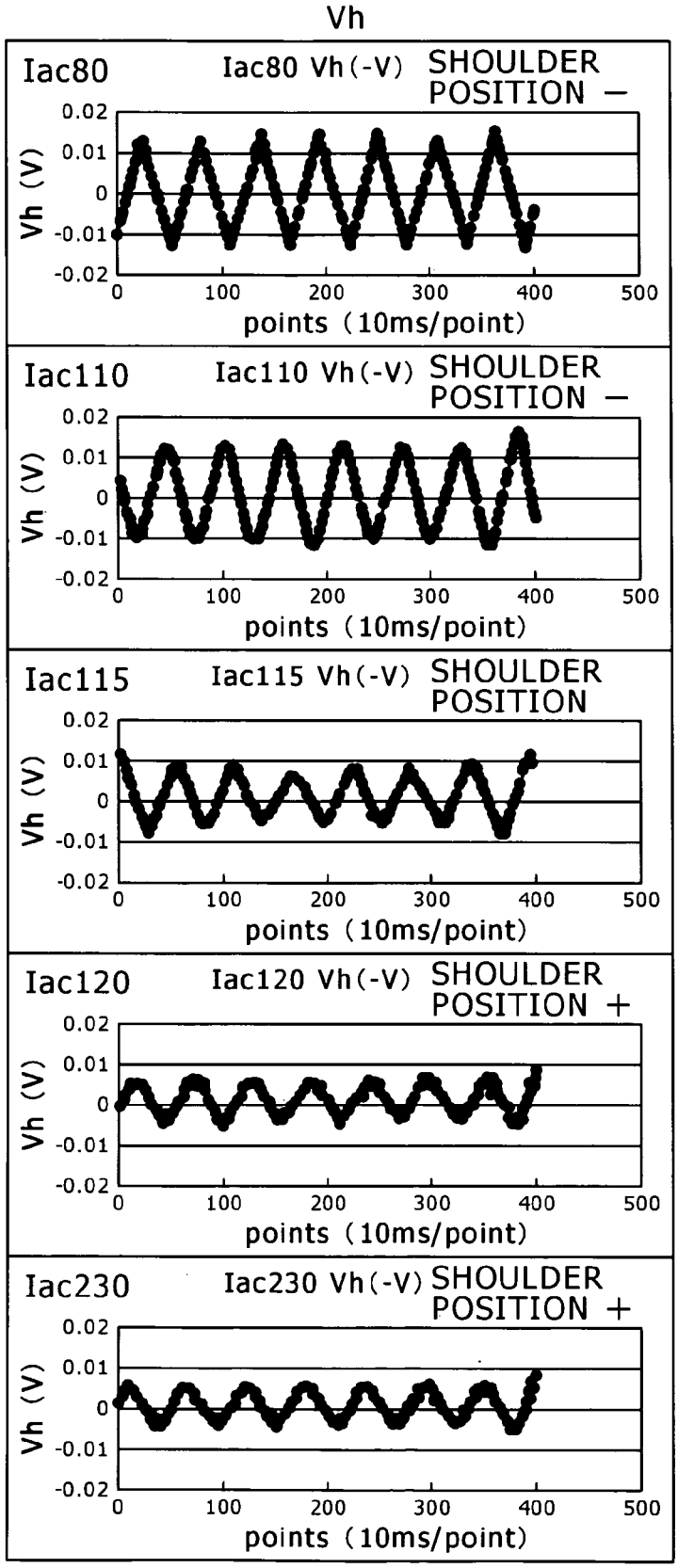
FIG. 6 is a group of graphs showing changes in charging potential of the photoreceptor drum in a charged condition of the surface of the photoreceptor drum using the charging device of the first exemplary embodiment.
Figure 7:
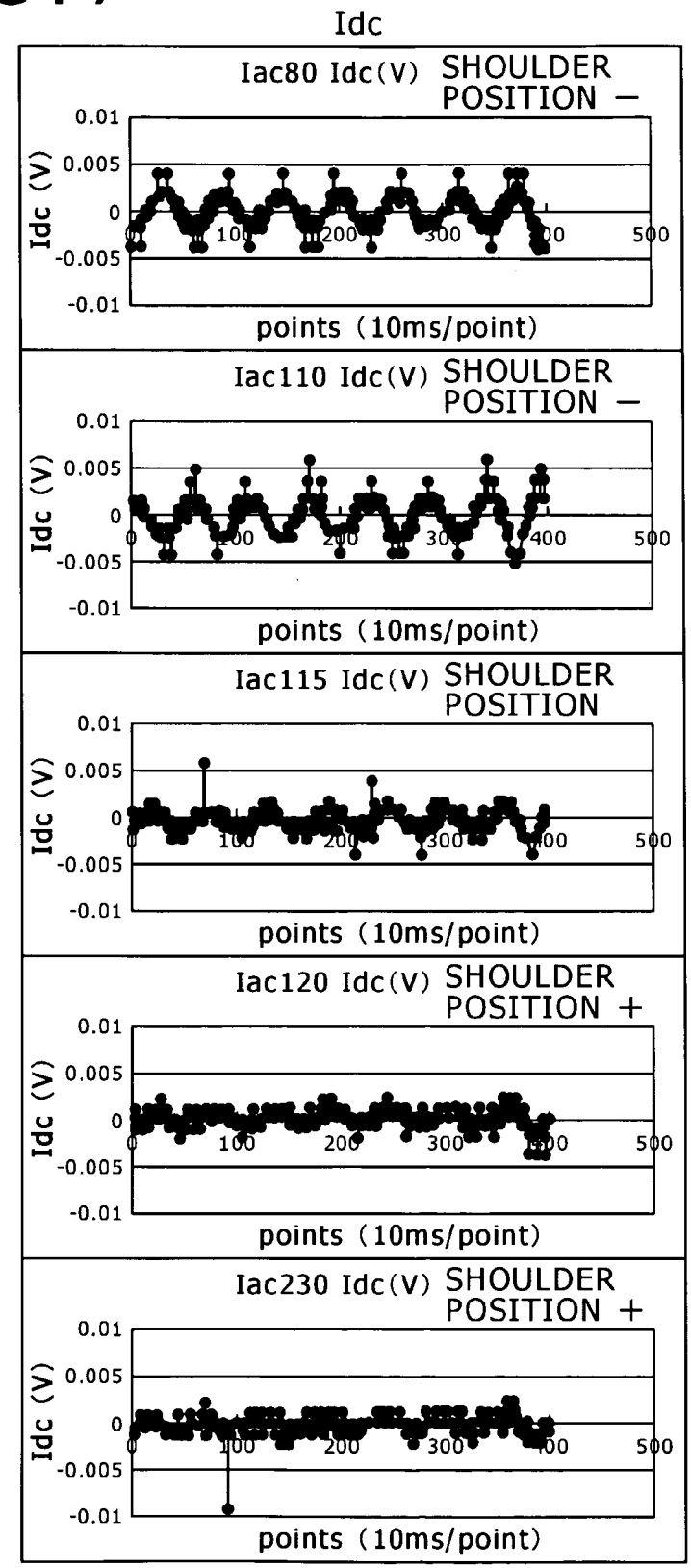
FIG. 7 is a group of graphs showing changes of specific components of a DC current flowing in a charging roller in a charged condition of the surface of the photoreceptor drum using the charging device of the first exemplary embodiment.

For obtaining the results shown in FIGS. 6 and 7, the DC current Idc flowing in each charging roller 16 is detected through a band pass filter 104 as a combination of both a low pass filter which passes therethrough a component of 2 Hz or lower and a high pass filter which passes therethrough a component of 1.6 Hz or higher, and the result obtained is sampled in synchronism with the charging potential Vh of the photoreceptor drum 15. The sampling rate is set to 0.01 Hz (10 ms/point). "Shoulder Position −" indicates ahead of the shoulder position in FIG. 5, "Shoulder Position" indicates the shoulder position in FIG. 5, and "Shoulder Position +" indicates behind the shoulder position in FIG. 5.

As is apparent from FIG. 6, as the AC current Iac applied to each charging roller 16 is increased gradually, a periodic variation of the charging potential Vh of the photoreceptor drum 15 gradually becomes smaller and, with the shoulder position (Iac=115) as a boundary, it becomes very small.

As is seen from FIG. 7, as the AC current Iac applied to each charging roller 16 is increased gradually, a periodic variation of the DC current Idc flowing in the charging roller 16 becomes smaller gradually and, with the shoulder position (Iac=115) as a boundary, it becomes almost constant. FIG. 7 illustrates the results of detection of the DC current Idc in terms of voltage.

Figure 8:
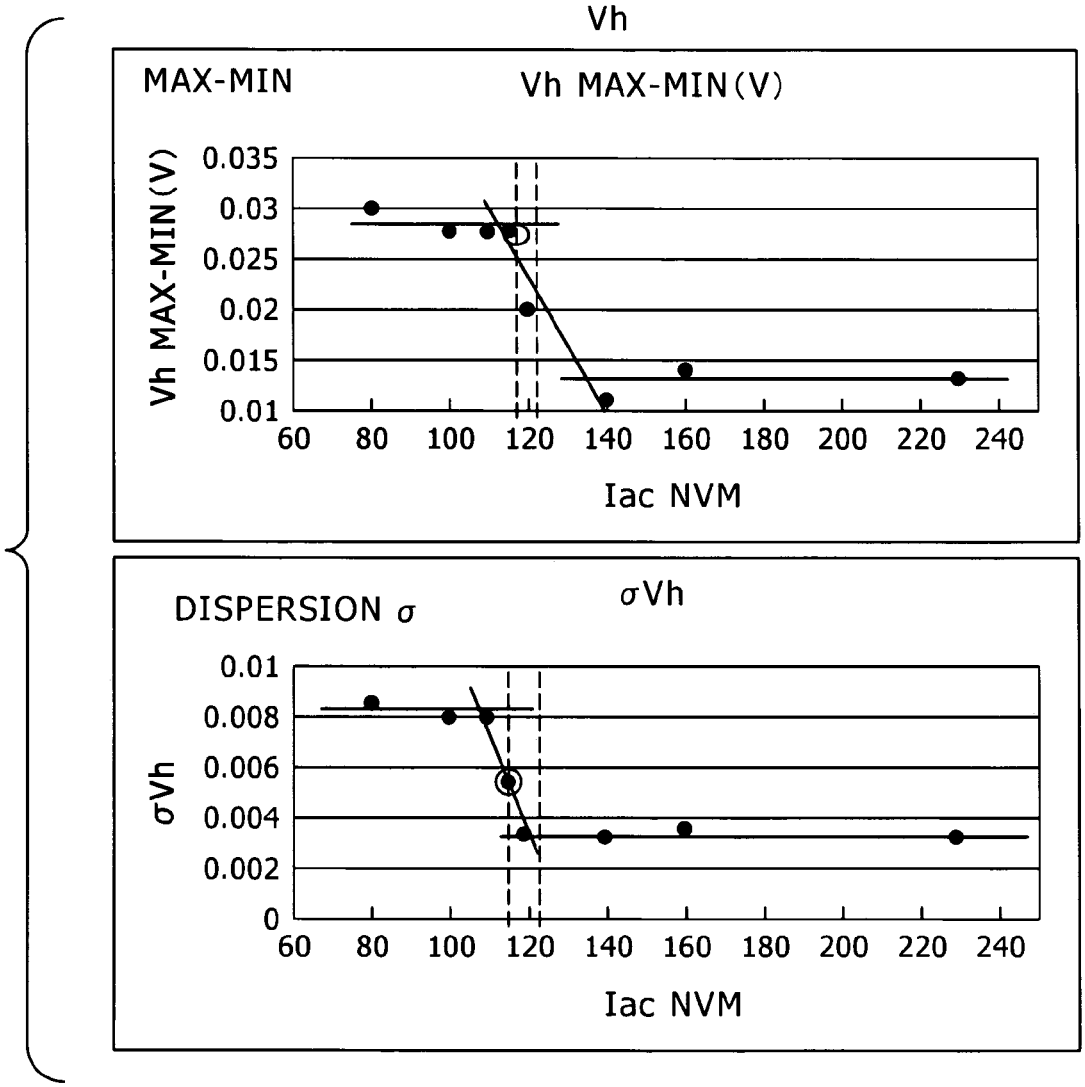
FIG. 8 is a group of graphs showing a maximum-minimum value difference and dispersion of the charging potential of the photoreceptor drum in a charged condition of the surface of the photoreceptor drum using the charging device of the first exemplary embodiment.
Figure 9:
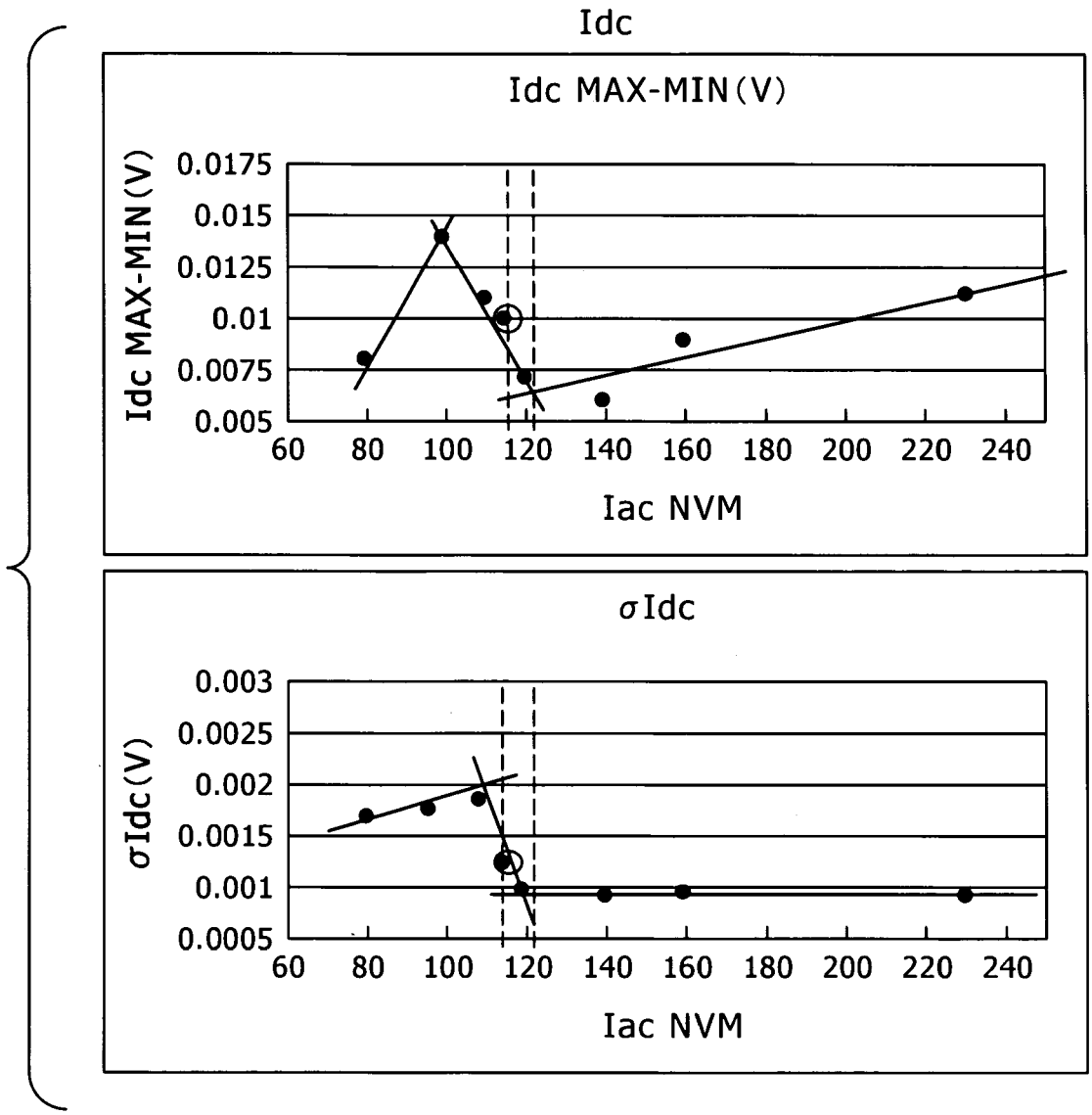
FIG. 9 is a group of graphs showing a maximum-minimum value difference and dispersion of specific components of the DC current flowing in the charging roller in a charged condition of the surface of the photoreceptor drum using the charging device of the first exemplary embodiment.

FIGS. 8 and 9 are graphs showing maximum-minimum difference values of the charging potential Vh of the photoreceptor drum 15 and the DC current Idc, as well as variance σ values of the charging potential Vh and the DC current Idc in a state in which the AC current Iac applied to the charging roller 16 is changed as noted above.

As known widely, the variance $\sigma^2$ represents $\sigma^2=(1/n)\cdot\Sigma(xi-xo)^2$ and a square root value σ of the variance is a standard deviation. In the above equation, xi stands for a value which takes variance, x0 stands for a mean value of variance-taking values, and n stands for the number of populations.

From FIGS. 8 and 9 and from the maximum-minimum value difference of the charging potential Vh of each photoreceptor drum 15 and the DC current Idc with respect to the AC current Iac applied to the associated charging roller 16, further from the value of variance σ of the charging potential Vh and DC current Idc, it is seen that the gradient becomes negative (an approximate straight line rises leftward) at a shoulder position of the charging potential Vh of the photoreceptor drum 15 and that a shoulder position is present near the negative region of the gradient.

In view of this point the CPU 100 makes control so that an AC current Iac with a certain margin (e.g., about 5%) anticipated for the AC current Iac at the shoulder position determined as above is applied to the charging roller 16 as indicated by dot-dash lines in FIGS. 8 and 9, whereby the surface of the photoreceptor drum 15 is charged constantly to a stable charging potential Vh.

Second Exemplary Embodiment

Figure 10:
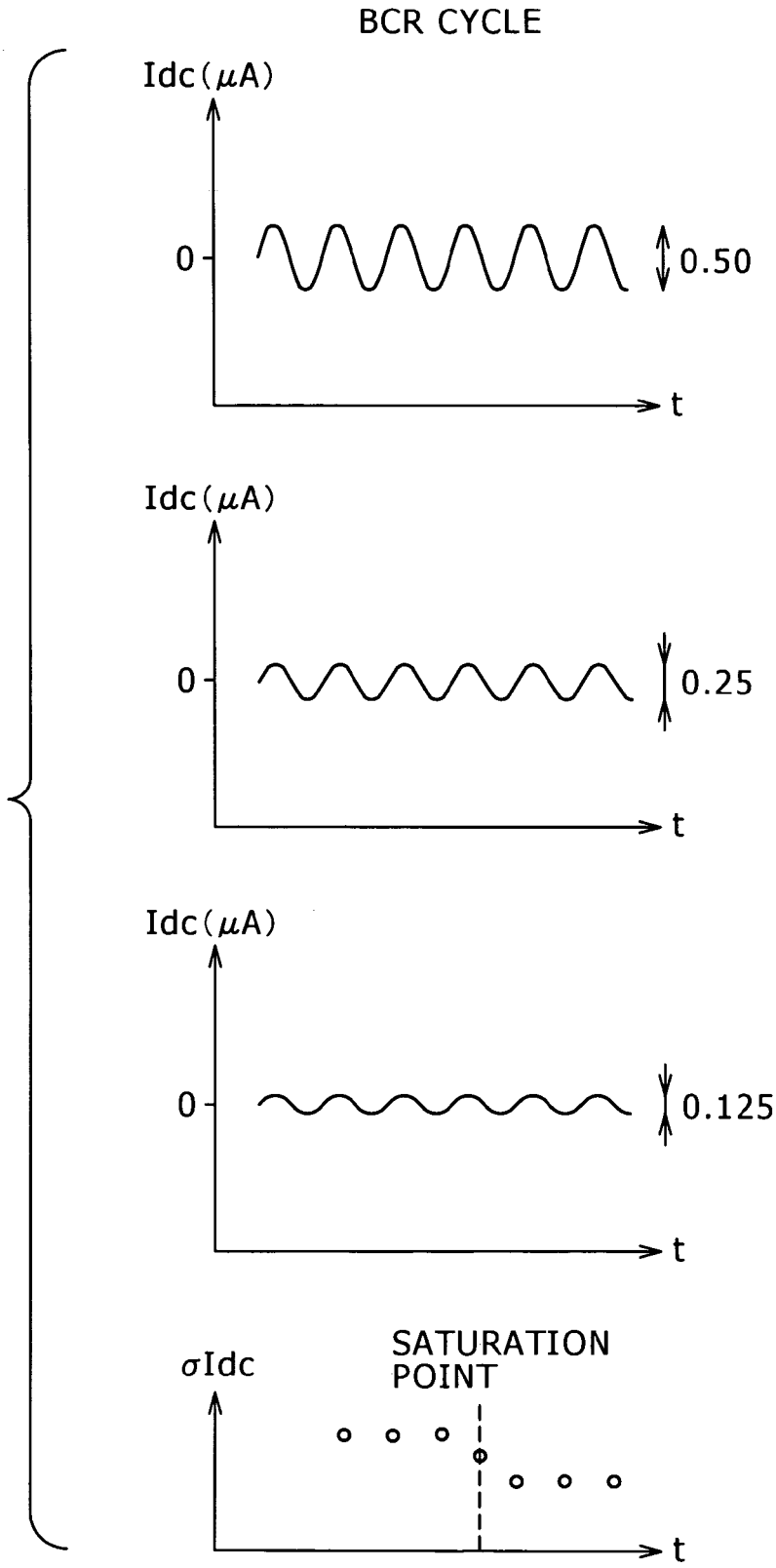
FIG. 10 is a group of graphs showing specific components of the DC current flowing in the charging roller in a charged condition of the surface of the photoreceptor drum using a charging device according to a second exemplary embodiment of the present invention.
Figure 11:
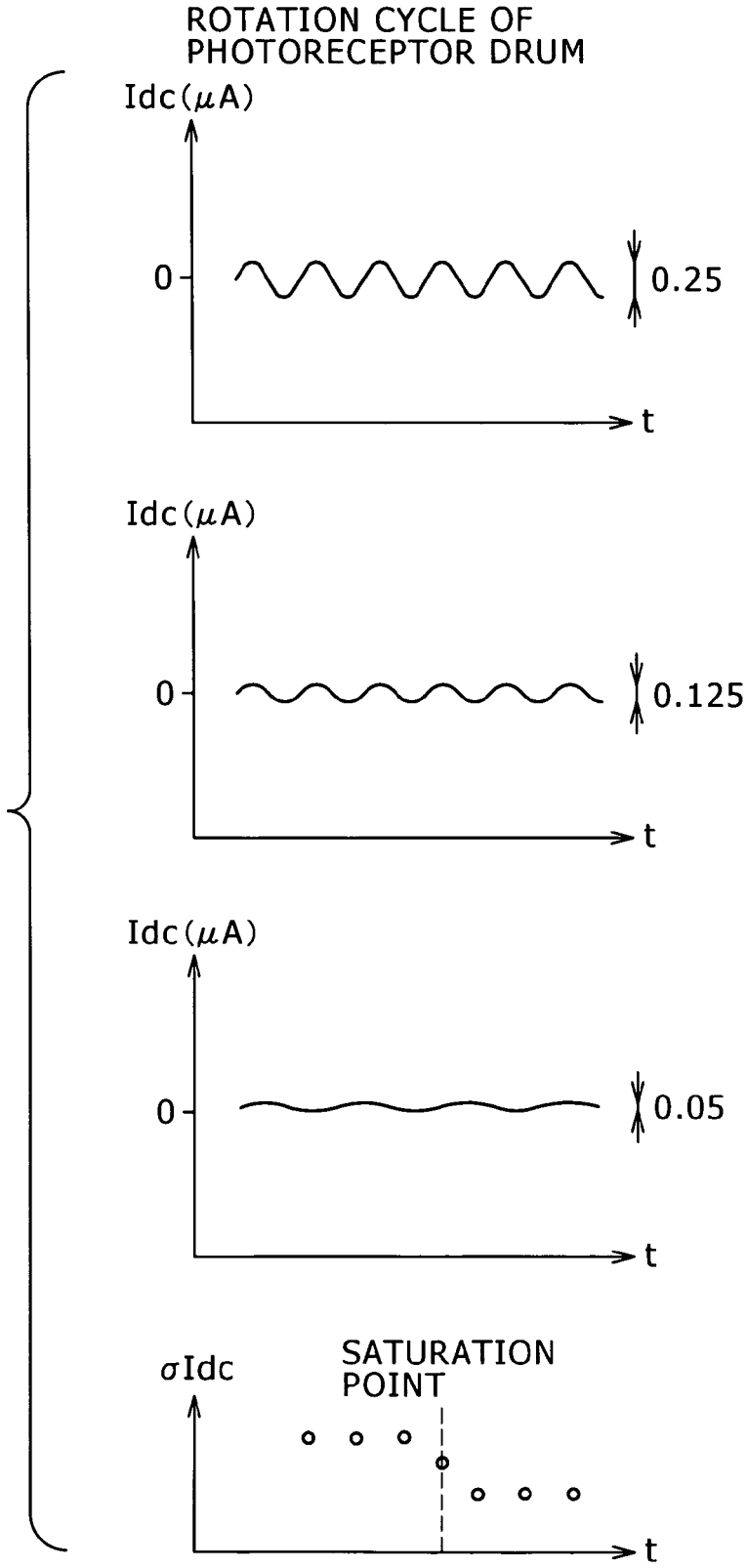
FIG. 11 is a group of graphs showing other specific components of the DC current flowing in the charging roller in a charged condition of the surface of the photoreceptor drum using the charging device of the second exemplary embodiment.

FIGS. 10 and 11 illustrate a second exemplary embodiment of the present invention. The same portions as in the first exemplary embodiment are identified by the same reference numerals as in the first exemplary embodiment. In this second exemplary embodiment, the filter is constructed so as to extract plural specific components from the DC current detected by the DC current detector and so as to permit switching from one to another of the specific components extracted from the DC current detected by the DC current detector.

More specifically, in this second exemplary embodiment, as shown in FIG. 4, a filter circuit 104 includes a first band pass filter 104*a* as a combination of both a low pass filter for passing therethrough a component of 2 Hz or lower and a high pass filter for passing therethrough a component of 1.6 Hz or higher and a second band pass filter 104*b* as a combination of both a low pass filter for passing therethrough a component of 5 Hz or lower and a high pass filter for passing therethrough a component of 4.5 Hz or higher. The first and second band pass filters 104*a*, 104*b* can be switched from one to the other by a change-over switch 105.

The first band pass filter 104*a* is set so as to extract only a component of a relatively low frequency corresponding to the rotation cycle of each photoreceptor drum 15, while the second band pass filter 104*b* is set so as to extract only a component of a relatively high frequency corresponding to the rotation cycle of each charging roller 16.

As shown in FIG. 1, on the basis of internal temperature and humidity data of the color multifunctional machine body 1 detected by the temperature sensor 110 and the humidity sensor 111, the CPU 100 determines whether the environment where the color multifunctional machine body 1 is installed is a high temperature, high humidity environment, an ordinary environment, or a low temperature, low humidity environment, and in accordance with the result of the determination, the band pass filter 104*a* and 104*b* are switched from one to the other by the change-over switch 105.

When the CPU 100 determines that the environment where the color multifunctional machine body 1 is installed is a high temperature, high humidity environment on the basis of the results of detection provided from the temperature sensor 110 and the humidity sensor 111, the CPU switches the change-over switch 105 to the use of the second band pass filter 104*b*.

That is, when the environment where the color multifunctional machine body 1 is installed is a high temperature, high humidity environment, the shoulder position shifts to the higher side of the AC current Iac applied to the charging roller 16, but if this condition is left as it is, the discharge product adhered to the surface of the photoreceptor drum 15 absorbs moisture contained in air and the resistance value becomes lower, thus making it impossible to detect highly accurately that the shoulder position has shifted to the higher side of the AC current Iac applied to the charging roller 16.

To avoid this inconvenience the CPU 100 switches the change-over switch 105 to the use of the second band pass filter 104*b*, thereby detecting a component of the DC current Idc of a frequency corresponding to the rotation cycle of the charging roller 16, as shown in FIG. 10. As a result, the discharge product is difficult to adhere to the surface of the charging roller 16 and therefore the shoulder position of the AC current Iac applied to the charging roller 16 can be detected with high accuracy without being influenced by the adhesion of the discharge product. Also in a high temperature, high humidity environment it is possible to charge the surface of the photoreceptor drum 15 to a predetermined charging potential with a high accuracy and hence possible to ensure a good image quality.

On the other hand, when the CPU 100 determines that the environment where the color multifunctional machine body 1 is installed is a low temperature, low humidity environment on the basis of the results of detection provided from the temperature sensor 110 and the humidity sensor 111, the CPU switches the change-over switch 105 to the use of the second band pass filter 104*b*.

That is, when the environment where the color multifunctional machine 1 is installed is a low temperature, low humidity environment, the shoulder position shifts to the lower side of the AC current Iac applied to the charging roller 16, but if this condition is left as it is, it becomes difficult to detect the movement of the shoulder position with a high accuracy under the influence of an adhered matter of a high resistance value such as toner adhered to the surface of the charging roller 16.

To avoid this inconvenience, the CPU 100 switches the change-over switch 105 to the use of the first band pass filer 104*a*, thereby detecting a component of the DC current Idc of a frequency corresponding to the rotation cycle of the photoreceptor drum 15, as shown in FIG. 11. As a result, residual toner is removed from the surface of the photoreceptor drum 15 by the associated cleaning device 18 and therefore the shoulder position of the AC current Iac applied to the charging roller 16 can be detected highly accurately without being influenced by the adhered matter of a high resistance value such as toner. Even in a low temperature, low humidity environment the surface of the photoreceptor drum 15 can be charged to a predetermined charging potential with a high accuracy and hence it is possible to ensure a good image quality.

Other constructional and operational points are the same as in the first exemplary embodiment and therefore an explanation thereof is here omitted.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A charging device, comprising:

a charging member disposed so as to rotate in contact with a surface of an image carrier to charge the image carrier surface;

a bias voltage applying unit that applies a bias voltage to the charging member, the bias voltage having an AC voltage superimposed on a DC voltage;

a DC current detector that detects a DC current flowing between the image carrier and the charging member;

a filter that extracts only a specific component from the DC current detected by the DC current detector; and a controller that controls at least one of an AC voltage and an AC current to be applied to the charging member in accordance with an amount of variation of the specific component extracted from the DC current by the filter.

2. The charging device according to claim 1, wherein the filter is configured to extract a plurality of components from the DC current detected by the DC current detector and so as to permit switching from one specific component to another as a specific component to be extracted from the DC current detected by the DC current detector.

3. The charging device according to claim 2, further comprising an environment sensor that detects temperature and humidity, and wherein on the basis of a result of the detection made by the environment sensor the filter switches from one specific component to another as a specific component to be extracted from the DC current detected by the DC current detector.

4. The charging device according to claim 1, wherein when at least one of the AC voltage and the AC current to be applied to the charging member is changed, the controller detects how a variance value of the specific component extracted from the DC current by the filter changes, and on the basis of the change in the variance value of the specific component of the DC current the controller controls at least one of the AC voltage and the AC current to be applied to the charging member.

5. A charging device, comprising:

a charging member disposed so as to rotate in contact with a surface of an image carrier to charge the image carrier surface;

a bias voltage applying unit that applies a bias voltage to the charging member, the bias voltage having an AC voltage superimposed on a DC voltage;

a DC current detector that detects a DC current flowing between the image carrier and the charging member;

an environment sensor that detects temperature and humidity;

a filter that, on the basis of a result of the detection made by the environment sensor, extracts only a frequency component corresponding to a rotation cycle of the charging member from the DC current detected by the DC current detector; and a controller that controls at least one of an AC voltage and an AC current to be applied to the charging member in accordance with an amount of variation of the frequency component extracted from the DC current by the filter and corresponding to a rotation cycle of the charging member.

6. The charging device according to claim 5, wherein when at least one of the AC voltage and the AC current to be applied to the charging member is changed, the controller detects how a variance value of the frequency component extracted from the DC current by the filter and corresponding to the rotation cycle of the charging member changes, and on the basis of the change in the variance value the controller controls at least one of the AC voltage and the AC current to be applied to the charging member.

7. A charging device, comprising:

a charging member disposed so as to rotate in contact with a surface of an image carrier to charge the image carrier surface;

a bias voltage applying unit that applies a bias voltage to the charging member, the bias voltage having an AC voltage superimposed on a DC voltage;

a DC current detector that detects a DC current flowing between the image carrier and the charging member;

an environment sensor that detects temperature and humidity;

a filter that, on the basis of a result of the detection made by the environment sensor, extracts only a frequency component corresponding to a rotation cycle of the image carrier from the DC current detected by the DC current detector; and a controller that controls at least one of an AC voltage and an AC current to be applied to the charging member in accordance with an amount of variation of the frequency component extracted from a DC current by the filter and corresponding to the rotation cycle of the image carrier.

8. The charging device according to claim 7, wherein when at least one of the AC voltage and the AC current to be applied to the charging member is changed, the controller detects how a variance value of the frequency component extracted from the DC current by the filter and corresponding to the rotation cycle of the image carrier changes, and on the basis of the change in the variance value the controller controls at least one of the AC voltage and the AC current to be applied to the charging member.

9. An image forming apparatus, comprising:

an image carrier;

a charging member disposed so as to rotate in contact with a surface of the image carrier to charge the image carrier surface;

a bias voltage applying unit that applies a bias voltage to the charging member, the bias voltage having an AC voltage superimposed on a DC voltage;

a DC current detector that detects a DC current flowing between the image carrier and the charging member;

a filter that extracts only a specific component from the DC current detected by the DC current detector;

an image write unit that writes an electrostatic latent image to the surface of the image carrier;

a developing unit that develops the electrostatic latent image formed on the surface of the image carrier with toner; and a controller that controls at least one of an AC voltage and an AC current to be applied to the charging member in accordance with an amount of variation of the specific component extracted from the DC current by the filter.

10. A charging controlling method comprising:

providing a charging member disposed to rotate in contact with a surface of an image carrier to charge the image carrier surface;

applying a bias voltage to the charging member, the bias voltage having an AC voltage on a DC voltage;

detecting a DC current flowing between the image carrier and the charging member;

extracting only a specific component from the detected DC current; and controlling at least one of an AC voltage and an AC current to be applied to the charging member in accordance with an amount of variation of the specific component extracted.

11. The charging controlling method according to claim 10, wherein the specific component is a frequency component corresponding to a rotation cycle of the charging member.

12. The charging controlling method according to claim 10, wherein the specific component is a frequency component corresponding to a rotation cycle of the image carrier.

* * * * *